United States Patent [19]

Hawley et al.

[11] Patent Number: 4,916,274

[45] Date of Patent: Apr. 10, 1990

[54] SNAP ACTION SUMP PUMP SWITCH

[75] Inventors: Richard H. Hawley, Torrington; Joseph L. G. Bouthet, Newington, both of Conn.

[73] Assignee: Cooper Industries, Inc., Houston, Tex.

[21] Appl. No.: 284,572

[22] Filed: Nov. 17, 1988

Related U.S. Application Data

[63] Continuation of Ser. No. 97,234, Sep. 16, 1987.

[51] Int. Cl.[4] ..... H01H 5/06

[52] U.S. Cl. ..... 200/457; 200/408

[58] Field of Search ..... 200/457, 405, 408, 409

[56] References Cited

U.S. PATENT DOCUMENTS

| | | | |
|---|---|---|---|
| 2,255,115 | 9/1941 | Helle | 200/457 |
| 3,996,436 | 12/1976 | Barney | 200/457 |
| 4,196,325 | 4/1980 | Povilaitis | 200/457 |

FOREIGN PATENT DOCUMENTS

| | | | |
|---|---|---|---|
| 1227506 | 8/1960 | France | 200/457 |

*Primary Examiner*—Renee S. Luebke

*Attorney, Agent, or Firm*—Nelson A. Blish; Eddie E. Scott; Alan R. Thiele

[57] ABSTRACT

A snap action switch is provided with an operating member in the form of an operating lever and a one piece actuating lever with a compression spring interposed therebetween.

2 Claims, 3 Drawing Sheets

SNAP ACTION SUMP PUMP SWITCH

This is a continuation of co-pending application Ser. No. 07/097,234 filed on Sept. 16, 1987.

BACKGROUND OF THE INVENTION

1. Field of the Invention

This invention relates to electric switches and, more particularly, to electric switches of the snap action type.

2. Statement of the Prior Art

Snap action switches are frequently used to control the starting and stopping of electric motors which operate pumps in response to the rise and fall of the level of water or other liquid. The rise and fall of liquid in sumps occurs at unpredictable rates which may also vary during the rise and fall. Normally, floats, connected with a switch operating lever or other means, will cause the separation and engagement of contacts to connect and disconnect the pump motor. The switch opening and closing movements, quite desirably, occur with a snap. Such snap action minimizes arcing at the contacts and thereby prolongs switch life.

Prior art snap action switches have several shortcomings. Those shortcomings arise, in part, because of the adverse conditions under which the switches are frequently employed. The presence of moisture causes contamination and failure of lubricated hinge joints. High inrush current and high temperature conditions form high resistance junctions at hinge joints in the current path which lead to base and cover meltdown and hazardous failure. Hinge joints are also susceptible to mechanical wear. As all prior art snap action switches have hinged joints, which may be lubricated, in the current path, all prior art snap action switches suffer, to some degree, the shortcomings outlined above.

SUMMARY OF THE INVENTION

The present invention overcomes the shortcomings of the prior art by providing a snap action switch in which hinged joints in the current path have been eliminated. The present invention includes a housing; a cover for that housing; at least two movable terminals mounted in the housing, each of the movable terminals having a free end; and at least two fixed terminals mounted in the housing, each associated with one of the movable terminals. Operating means for the present invention, that is operating means for moving the free ends of the movable terminals between a stable position in contact with the associated fixed terminals and a stable position out of contact with the fixed terminals, includes lever pivot means including a pivot shaft mounted in a depression means in a transverse interior wall in the housing; a one piece actuation lever having a portion pivotally received in a notch formed to some extent by a portion of said housing, the actuating lever having spaced side legs connected to the free ends of the movable terminals, the actuating lever further having a spring end receiving portion; an operating lever mounted on the pivot shaft for pivotal movement thereon, the operating lever having a one lever portion on one side of the pivot shaft extending in the direction of the actuating lever; and a compression spring interposed between the one lever portion of the operating lever and the spring receiving portion of the actuating lever.

Accordingly, it is a major objective of the present invention to provide a novel single throw, snap action switch which operates predictably and reliably under high temperature ambient and high inrush current conditions.

It is another object of the present invention to provide a novel snap action switch having long electrical and mechanical life for use with both submersible and pedestal type float or weight actuated sump pumps.

It is yet another object of the present invention to provide a novel snap action switch in which hinge joints in the current path; which cause high resistance, high temperature junctions which, in turn, can cause base and cover meltdown and hazardous failure; are eliminated.

It is still yet another object of the present invention to provide a novel snap action switch in which mechanical wear at the hinge joints and lubrication at these points, sources of contamination, are eliminated.

A further object of the present invention is to provide a novel snap action switch in which contact pressures on both sides are equalized by not allowing ends of contact arms to float free.

Other objects, advantages and novel features of the invention will become apparent from the following detailed description of the invention when considered in conjunction with the accompanying drawings wherein:

DETAILED DESCRIPTION OF THE INVENTION

Figure 1:
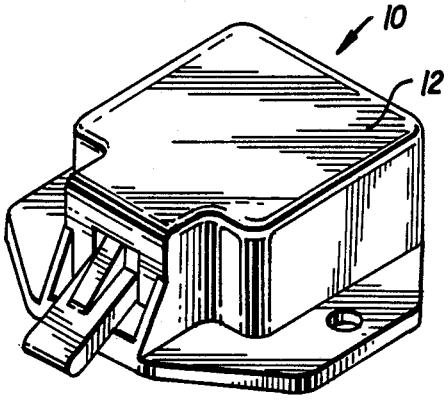
FIG. 1 is a perspective view of the top of an embodiment of the snap action switch of the present invention.
Figure 3:
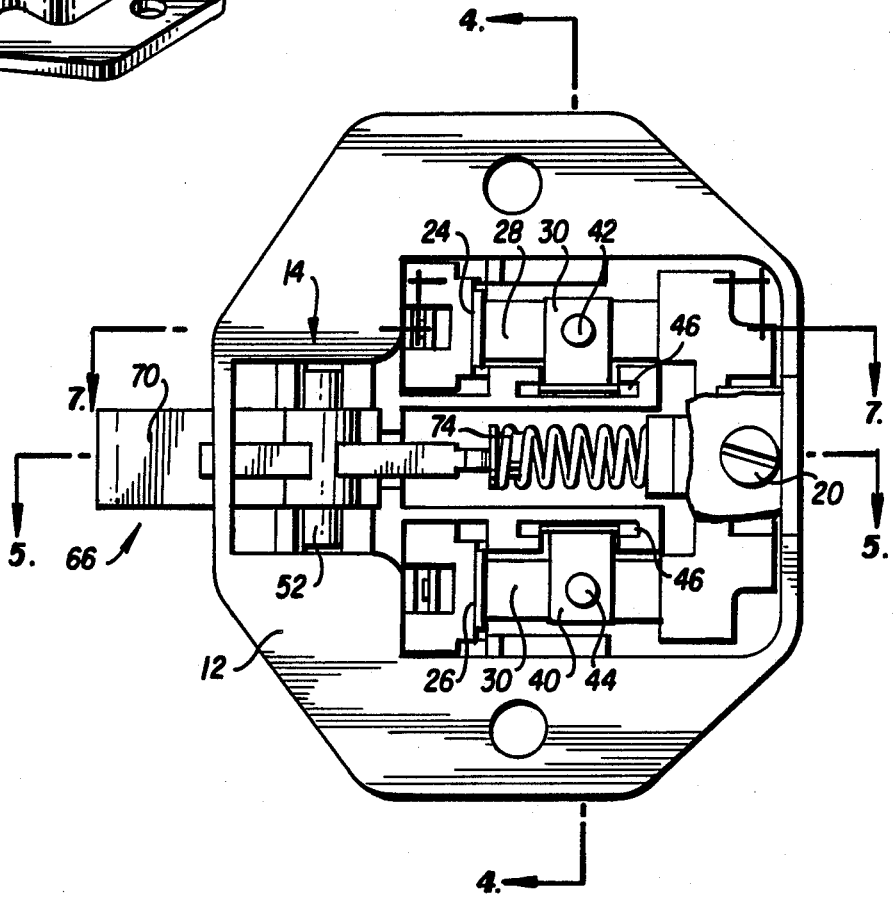
FIG. 3 is a bottom plan view of the embodiment of the present invention shown in FIGS. 1 and 2.

Referring now to the drawings wherein like reference characters designate identical or corresponding parts throughout the several views, shown therein is an embodiment of a snap action switch according to the present invention, indicated generally as 10. Switch 10 is a double pole form of the present invention. Switch 10 includes a housing 12 which, preferably, is suitably molded of an electrically insulating plastic material. Particular shape and size of housing 12 are not critical, provided that certain elements described below can be mounted in that housing and further provided that housing 12 has an interior portion, generally designated as 14, with depression means therein.

Figure 2:
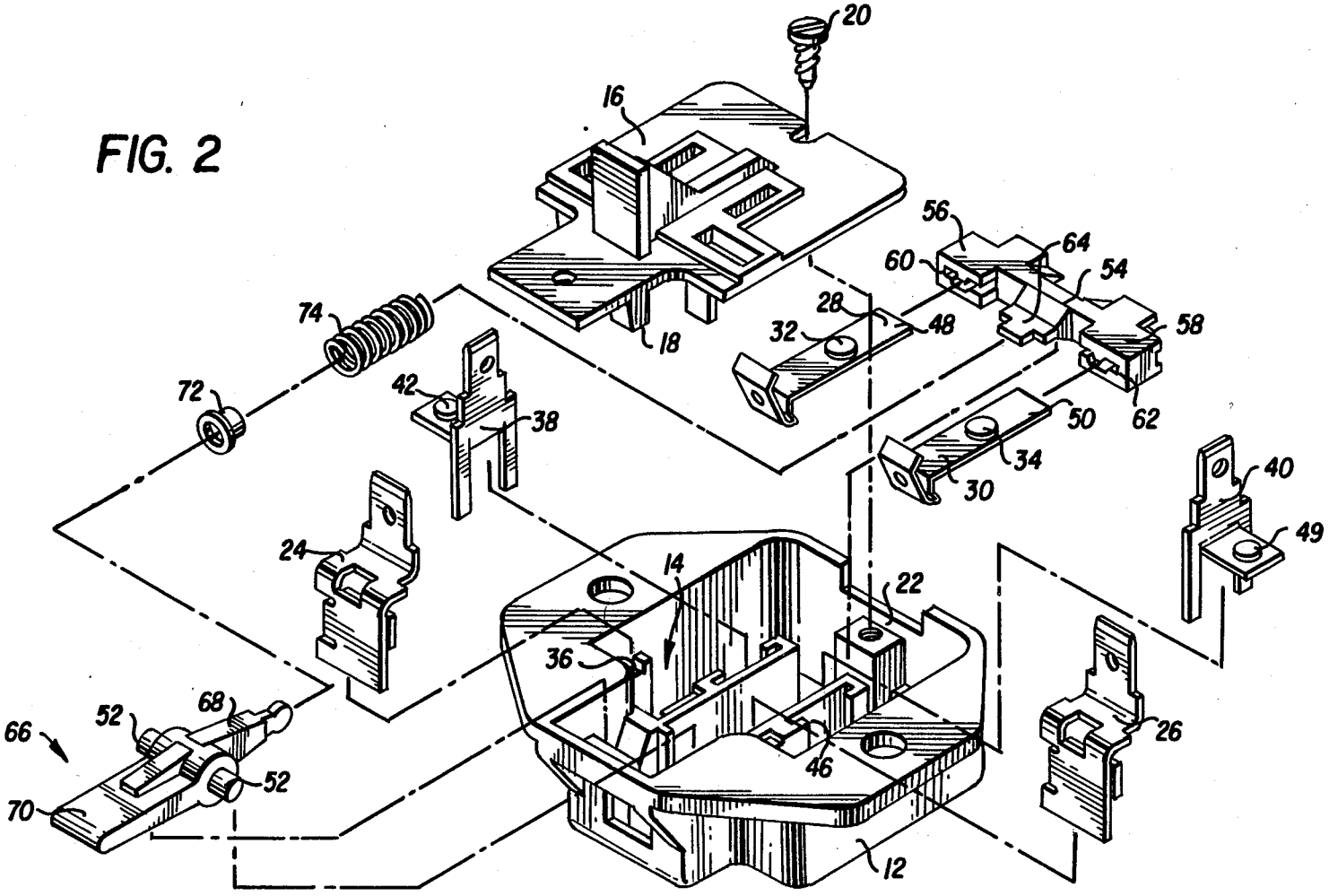
FIG. 2 is an exploded view of the embodiment of the snap action switch of the present invention shown in FIG. 1.
Figure 4:
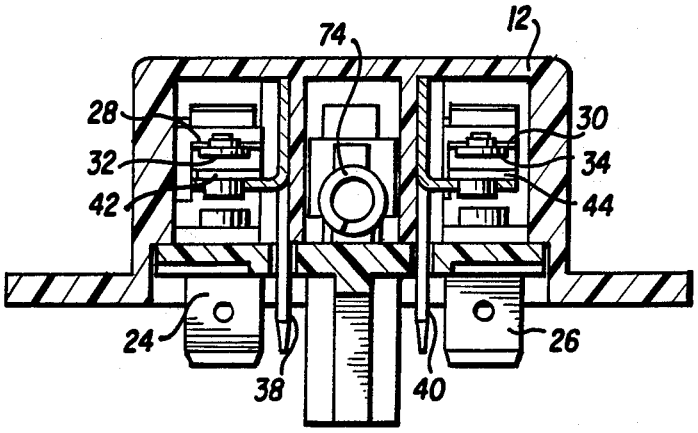
FIG. 4 is a cross-sectional view taken along line 4—4 of FIG. 3.

In FIG. 2, it is seen that switch 10 also includes a cover 16 for housing 12. Cover 16, like housing 12, is, preferably, suitably molded of electrically insulating material. Also, in the embodiments shown in the drawings, cover 16 has a portion 18 which is capable of retaining a pivot shaft, such as the one described further below, in the depression in housing portion 14. In FIG. 2 it can also be seen that the switch may include means, such as screw 20, for securing cover 16 to housing 12. Of course, as in FIG. 2, in such an event housing 12 could include means, such as screw receiving bore 22, for facilitating operation of the cover securing means. In certain embodiments of the present invention, such as in the embodiment illustrated in various figures that are a part of the present disclosure, cover 16 may also have portions which form to some extent (perhaps acting in conjunction with portions of housing 12) a notch for pivotally receiving an actuating lever that is described further below. In the particular embodiment illustrated in the figures that are a part of this application, these portions of cover 16 are in the form of two chamfered towers which straddle a drive screw tower formed on housing 12. Bore 22 is formed by the drive screw tower.

Within housing 12 are mounted a pair of movable terminals, each including a terminal member 24, 26 and a respective free-arm member 28, 30. The terminal members 24, 26 and respective free-arm members 28, 30 are formed by conventional techniques from metal or alloys having good electrical conductivity and resiliency. On free-arm members 28, 30 are mounted contact buttons 32, 34. As best understood with reference to FIGS. 7 and 8, which show terminal member 24 and free-arm member 28, the terminal members 24, 26 interlock metal to metal and are spot welded to respective free-arm members 28, 30. So interlocked, spot welded and, thus, connected, the terminal members are mounted within housing 12, in the embodiments shown in the drawings, by being received within slots in housing 12 where they can be retained by the presence of cover 16.

Also mounted within housing 12 are a pair of fixed terminals 38, 40. Like the elements 24, 26, 28, 30 of the movable terminals, fixed terminals 38, 40 are formed of metals or alloys having good electrical conductivity. Fixed terminals 38, 40 also include contact buttons 42, 44, each of which is associated with a respective one of the two contact buttons 32, 34 on the movable terminals. Further, much like the movable terminal members 24, 26, in the embodiments shown in the drawings, mounting of the fixed terminals 38, 40 is accomplished by their positioning and retention within slots 46 in housing 12.

According to the present invention, there is provided operating means for moving the free, that is, unconnected to members 24, 26 ends of free-arm members 28, 30 between two stable positions. In one stable position, contact button pairs 32 and 42 and 34 and 44 are both in contact; in the other stable position, contact buttons 32 and 42 and contact buttons 34 and 44 are separated. More specifically, this operating means includes a lever pivot means including a pivot shaft 52 mounted in the depression means in portion 14 of the housing 12 of switch 10. As was mentioned above, when shaft 52 is so mounted, it may be pivotably held in position in the depression by the presence of a portion 18 on cover 16, when cover 16 is properly secured to housing 12.

The operating means further includes a one piece actuating lever 54 pivotally received in two notches formed by housing 12 and cover 16. Actuating lever 54 has spaced apart side legs 56, 58 connected to respective free ends 48, 50 of movable terminal members 28, 30. This connection may be accomplished by slots 60, 62 as in the embodiment shown or by any of a multitude of other connection techniques well known to those skilled in the relevant art. Lever 54 further has a spring-end receiving portion 64 which forms part of the means mentioned above for retaining lever 54 in the notches described above. Like housing 12 and covers 16, lever 52 is, preferably, suitably molded of electrically insulating plastic material. The unitary character of lever 54 is a very important aspect of the present invention. Prior art switches contain non-unitary elements performing functions identical and/or similar to the functions performed by lever 54. Multiple parts performing quick movement functions, as here, frequently involve hinges or have other characteristics or aspects which collect heat and/or cause rapid wear and/or otherwise cause switch failure much more rapidly than in the case of the snap action switch of the present invention.

Still further, the operating means includes an operating lever 66 directly mounted on pivot shaft 52 for pivotal movement thereon. A first lever portion 68 of operating lever 66 on one side of pivot shaft 52 extends in the direction of actuating lever 54. The distal portion of this portion 68 may include a surface adapted to accommodate a spring and/or, as in the embodiments shown in the drawings, it may be adapted to accommodate an intermediate element 72, which element 72 is capable of accommodating a spring end. A second lever portion 70 of lever 66, is capable of serving as a connection point to a float or other such switch trigger.

As may be gathered from the discussion above, the operating means also includes a compression spring 74. Compression spring 74 is interposed between the first lever portion 68 of lever 66 and the spring receiving portion 64 of lever 54.

Figure 8:
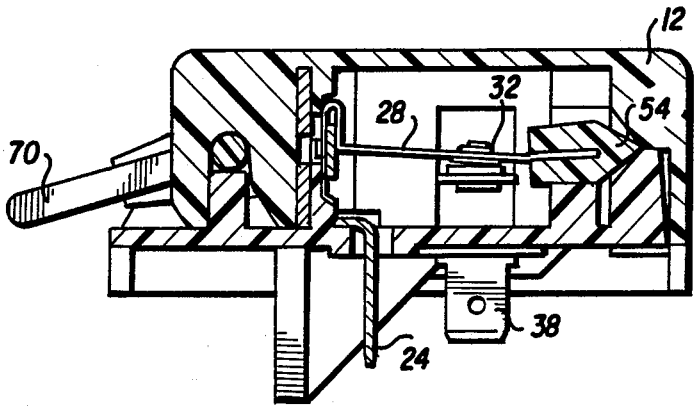
FIG. 8 is a cross-sectional view as in FIG. 7, this view showing positions of certain elements when the switch is closed.
Figure 5:
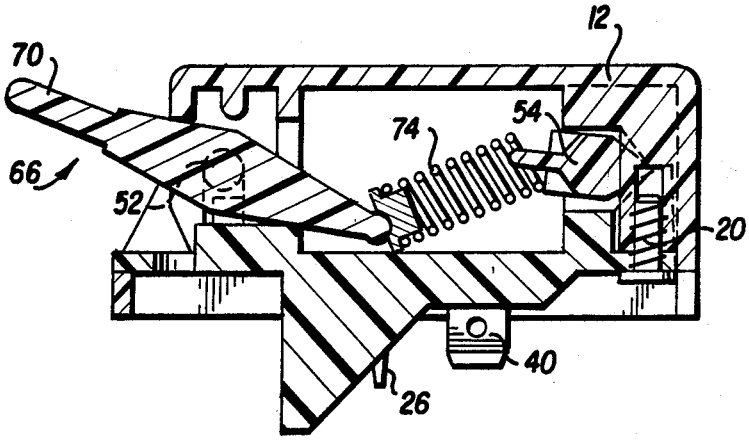
FIG. 5 is a cross-sectional view taken along line 5—5 of FIG. 3, this view showing positions of certain elements when the switch is open.
Figure 6:
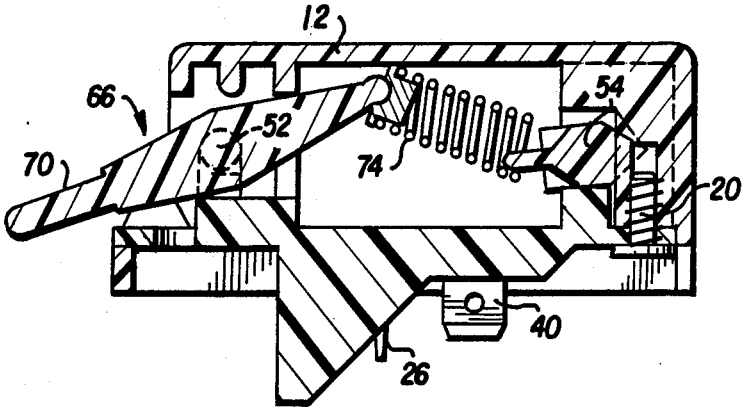
FIG. 6 is a cross-sectional view as in FIG. 5, this view showing positions of certain elements when the switch is closed.
Figure 7:
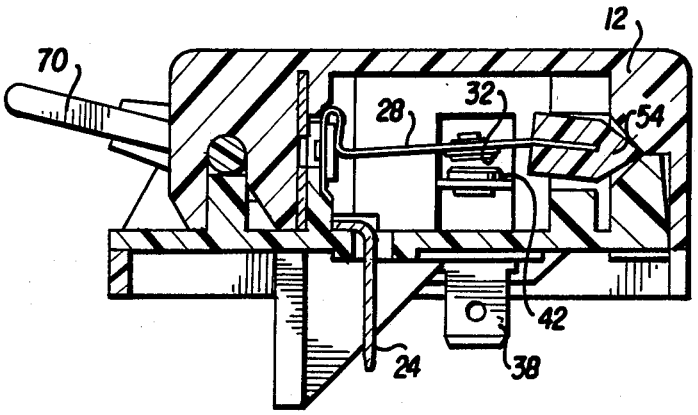
FIG. 7 is a cross-sectional view taken along line 7—7 of FIG. 3, this view showing positions of certain elements when the switch is open.

In operation, compression spring 72 maintains actuating lever 54 in one of its two stable positions. Referring to FIGS. 5 and 6, it should be understood and appreciated that movement of portion 68 from one of its stable operating positions into parallel alignment with actuating lever 54 compresses spring 74, the spring expanding when the levers 54 and 66 pass through the parallel alignment to rapidly move the levers and the movable terminals into their opposite stable positions. FIGS. 7 and 8 correspond to FIGS. 5 and 6 but show terminal positions rather than spring and lever positions. From the foregoing, it should be appreciated that a slow movement of operating lever 66 results in a snap action operation of the switch terminals.

Obviously, numerous modifications and variations of the present invention are possible in light of the above teachings. It is therefore to be understood that within the scope of the appended claims, the present invention may be practiced otherwise than as specifically described herein.

We claim:

1. A snap action switch having an operating lever, said snap action switch comprising:

a housing having an interior wall with a depression therein;

a cover for said housing;

at least two movable terminals mounted in said housing, each of said movable terminals having a free end;

at least two fixed terminals mounted in said housing, each associated with one of said movable terminals;

operating means for moving the free ends of said movable terminals between a stable position in contact with said associated fixed terminals and a stable position out of contact with said fixed terminals, said operating means comprising:

lever pivot means including a pivot shaft mounted in the depression in the wall of said housing;

a one piece actuating lever having a portion pivotally received in a notch formed to some extent by a portion of said housing which is spaced apart from said depression mounting said pivot shaft, said actuating lever having spaced side legs connected to the free ends of said movable terminals, said actuating lever further having a spring end receiving portion;

an operating lever mounted on said pivot shaft for pivotable movement thereon, said operating lever having a first lever portion on one side of said pivot shaft extending in the direction of said actuating lever; and a compression spring interposed between said first lever portion of said operating lever and the spring receiving portion of said actuating lever.

2. The snap action switch of claim 1 wherein the notch which pivotally receives a portion of said one piece actuating lever is formed by a portion of said housing and by a portion of said housing cover.

* * * * *